US006412423B1

(12) United States Patent
Elizondo, Jr.

(10) Patent No.: US 6,412,423 B1
(45) Date of Patent: Jul. 2, 2002

(54) SLEEVED HINGE FOR A WALL MOUNTED IRONING BOARD

(75) Inventor: Baldemar Elizondo, Jr., Broken Arrow, OK (US)

(73) Assignee: Hide-Away Ironing Boards, Inc., Tulsa, OK (US)

( * ) Notice: Subject to any disclaimer, the term of this patent is extended or adjusted under 35 U.S.C. 154(b) by 0 days.

(21) Appl. No.: 09/606,916

(22) Filed: Jun. 29, 2000

(51) Int. Cl.[7] ..... A47B 3/00
(52) U.S. Cl. ..... 108/35; 211/104
(58) Field of Search ..... 108/33, 48, 42, 108/35, 134; 211/104

(56) References Cited

U.S. PATENT DOCUMENTS 2,160,435 A * 5/1939 Jensen ..... 108/33
2,658,294 A * 11/1953 Hull ..... 108/48
D272,008 S 12/1983 Flory
4,779,539 A 10/1988 Stiglich
4,862,811 A 9/1989 Davis
4,961,388 A 10/1990 Simpson
4,995,681 A 2/1991 Parnell
5,369,898 A 12/1994 Sorensen
5,709,044 A 1/1998 Atapattu
5,778,573 A 7/1998 Nottingham et al.

* cited by examiner

*Primary Examiner*—Peter M. Cuomo
*Assistant Examiner*—Jerry A. Anderson
(74) *Attorney, Agent, or Firm*—Molly D. McKay

(57) ABSTRACT

A telescoping sleeved hinge for use in association with a wall mounted ironing board that allows the ironing board to pivot downward to a horizontal position where the sleeved hinge is fully retracted within itself in order to support the board, and alternately, pivot upward to a vertical position where the telescoping sleeved hinge is received within a groove provided on the underneath side of the board, allowing the board to be stored in a thin profile cabinet. The telescoping hinge allows the back of the board to pivot along a single axis within the cabinet.

7 Claims, 3 Drawing Sheets

10
12
48
46
54
60
50
20
63

10
12
46
48
54
66
50
66
20
63

58
64

9
58
65
64
65

52

10
34
26
38
28
40
24
30
32
36

5
10
34
26
38
28
40
24
30
32
36
5

SLEEVED HINGE FOR A WALL MOUNTED IRONING BOARD

BACKGROUND OF THE INVENTION

1. Field of the Invention

The present invention relates to a sleeved hinge for use with a wall mounted ironing board. The telescoping hinge allows the ironing board to pivot downward to a horizontal position, and alternately, pivot upward to a vertical position so that it is contained within a very thin cabinet for storage. Also, the telescoping hinge allows the back of the board to pivot along a single axis within the cabinet, instead of sliding upward and downward relative to the cabinet, as is the case with prior art wall mounted ironing boards.

2. Description of the Related Art

One of the objectives in building wall mounted ironing boards is to produce a cabinet that is thin and can be mounted on the wall of the user's dwelling without having to place the cabinet into the wall itself, i.e. avoiding having to build in the cabinet by placing it between the studs of the wall.

Until now, prior art wall mounted ironing boards usually folded up in the cabinet by sliding the back of the board relative to the cabinet. In this arrangement, the cabinet had to be thick because the back of the ironing board moved in a track within the side walls of the cabinet. And the side walls had to be thick enough to provide sufficient strength for the track to be cut into each side of the cabinet. These thick cabinets were generally awkward to mount on the surface of the wall and were in the way when they were mounted to the wall of the user's dwelling. In addition to being undesirable for use in a small room or otherwise close quarters within the user's dwelling, the thick cabinet of prior art wall mounted ironing boards was visually unattractive due to its thick configuration.

Also, in trying to make the cabinet and the board as thin as possible, it was difficult to achieve a strong and solid horizontal position for the ironing board when the board was in use.

The present invention addresses these problems by providing a telescoping hinge that attaches by one end to the inside bottom of the cabinet and on its other end to the underneath side at the front end of the board. The bottom of the board is provided with a groove that receives the telescoping hinge when the board is pivoted upward into its storage position. The back end of the board is pivotally mounted to the sides of the cabinet so that the board pivots to allow the board to be moved between its raised vertical storage position and its lowered horizontal in use position. This arrangement allows the cabinet to be made so that it very thin.

Also, the board is particularly stable and strong when in its horizontal position. This is because the hinge, which supports the board, has the smaller of its two telescoping pieces fully inserted within the larger of its two pieces when the board is in its horizontal position.

SUMMARY OF THE INVENTION

The present invention is a sleeved hinge for use in association with a wall mounted ironing board. The telescoping hinge allows the ironing board to pivot downward to a horizontal position, and alternately, pivot upward to a vertical position where it is contained within a cabinet for storage. Also, the telescoping hinge allows the back of the board to pivot along a single axis within the cabinet.

The telescoping hinge pivotally attaches by one end to the inside bottom of the cabinet and pivotally attaches on its other end to the underneath side of the board at the front end of the board. The underneath side of the board is provided with a groove that receives the telescoping hinge when the board is pivoted upward into its storage position. The back end of the board is pivotally mounted to the sides of the cabinet so that the board pivots to allow the board to be moved between its raised vertical storage position and its lowered horizontal in use position. This arrangement allows the cabinet to be made so that it very thin.

The board is particularly stable and strong when it is in its horizontal position. This is because the hinge, which supports the board, has the smaller of its two telescoping pieces fully inserted within the larger of its two pieces when the board is in its horizontal position.

DETAILED DESCRIPTION OF THE PREFERRED EMBODIMENT

The Invention

Figure 1:
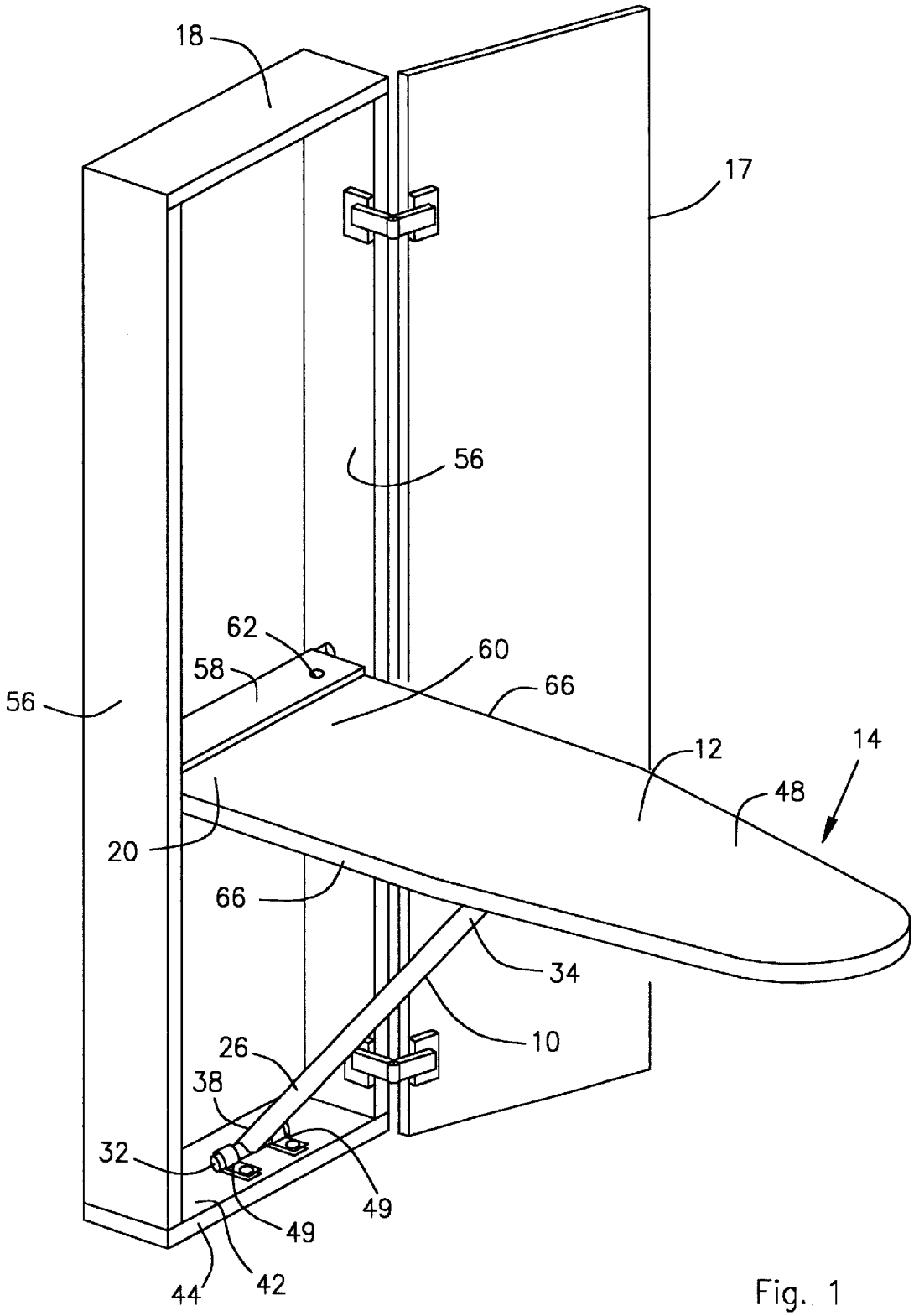
FIG. 1 is a perspective view of a sleeved hinge constructed in accordance with a preferred embodiment of the present invention show in use on a wall mounted ironing board.

Referring now to the drawing and initially to FIG. 1, there is illustrated a sleeved hinge 10 constructed in accordance with a preferred embodiment of the present invention. The sleeved hinge 10 of FIG. 1 is shown in use in association with a wall mounted ironing board 12.

Figure 3:
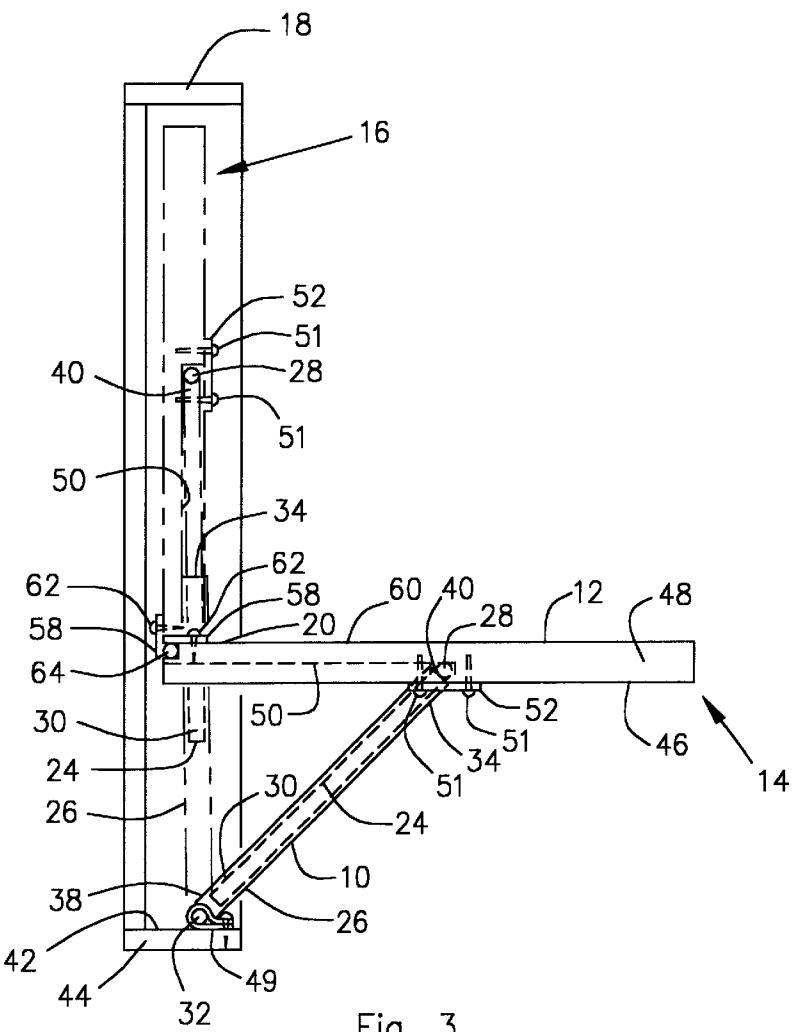
FIG. 3 is a right side view of the wall mounted ironing board taken along line 3—3 of FIG. 2, showing the ironing board in its horizontal position and showing its vertical position in outline.
Figure 2:
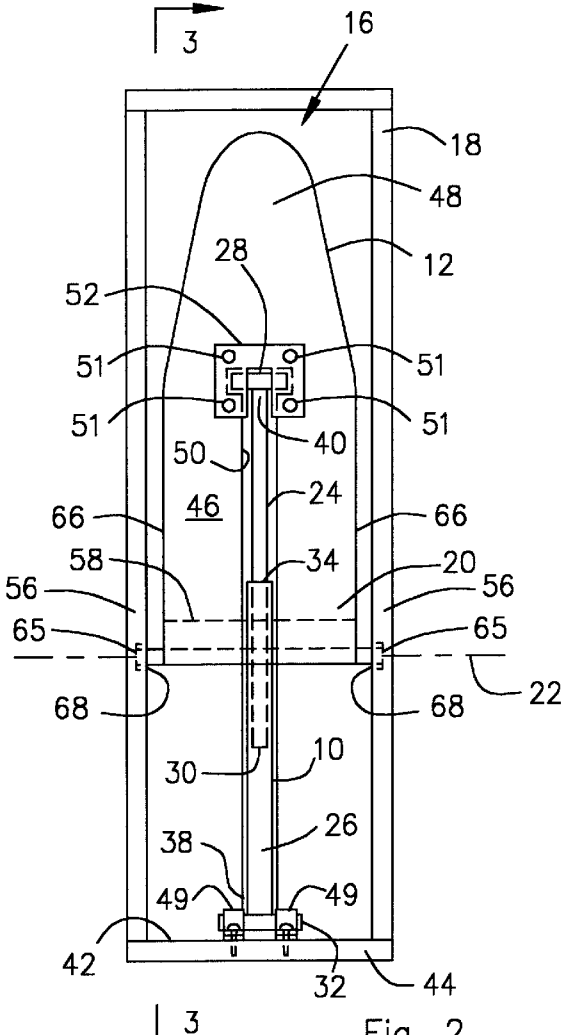
FIG. 2 is a front view of the wall mounted ironing board of FIG. 1 shown in its vertical position.

Referring now also to FIGS. 2 and 3, the sleeved hinge 10 telescopes to allow the ironing board 12 to pivot downward to a horizontal position 14, and alternately, pivot upward to a vertical position 16. When pivoted upward in its vertical position, a the ironing board 12 can be stored hidden from view by closing a cabinet door 17 provided on a cabinet 18 in which the ironing board 12 is pivotally mounted. The telescoping hinge 12 allows a back end 20 of the board 12 to pivot along a single axis 22 within the cabinet 18, as illustrated in FIG. 2.

Figures 4, 5, 6, 7, 8, 9, 10:
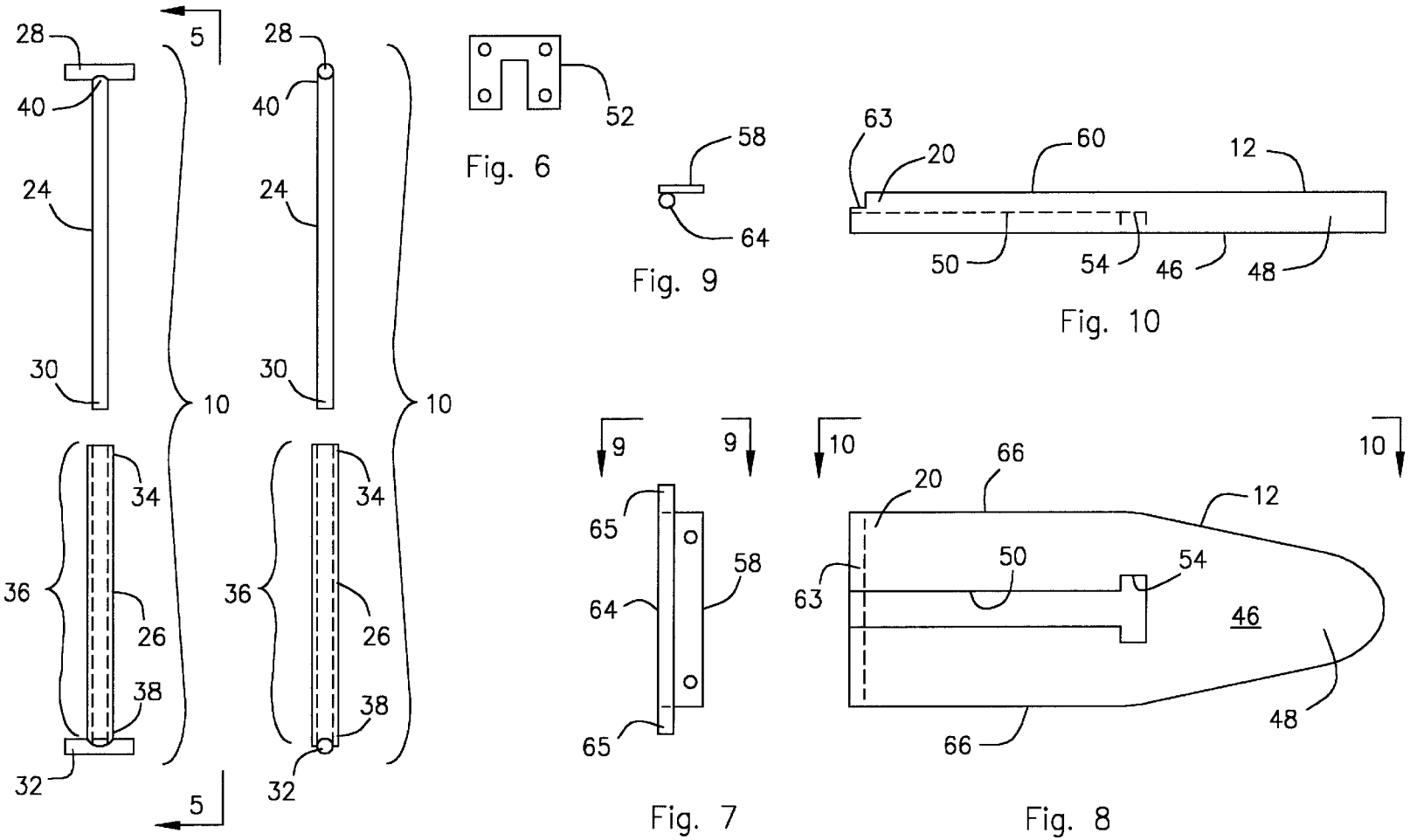
FIG. 4 is an exploded front view of the sleeved hinge of FIG. 1.
FIG. 5 is an exploded left side view of the sleeved hinge of FIG. 4, taken along line 5—5 of FIG. 4.
FIG. 6 is a bracket that secures a second end of the sleeved hinge to the underneath side of the board in a t-shaped groove provided in the board.
FIG. 7 is a bottom plan view of a pivotal attachment bracket that secures the back end of the board to the cabinet.
FIG. 8 is a bottom plan view of the board, showing the t-shaped groove provided therein.
FIG. 9 is a right side view of the pivotal attachment bracket taken alone 9—9 of FIG. 7.
FIG. 10 is a right side view of the board taken along line 10—10 of FIG. 8.

As best illustrated in FIGS. 4 and 5, the telescoping hinge 10 is comprised of two pieces: a t-shaped bar 24 that is telescopically received within a t-shaped sleeve 26. The t-shaped bar 24 has a t-shaped end 28 and an opposite straight end 30. Likewise, the t-shaped sleeve 26 has a t-shaped end 32 and an opposite straight end 34. The straight end 34 is hollow along an entire length 36 of the t-shaped sleeve 26 so that it can telescopically receives the straight end 30 of the t-shaped bar 24. The t-shaped end 32 of the t-shaped sleeve 26 serves as a first end 38 of the telescoping hinge 10, and the t-shaped end 28 of the t-shaped bar 24 serves as a second end 40 of the telescoping hinge 10. The telescoping hinge 10 pivotally attaches by its first end 38 to an inside surface 42 of a bottom 44 of the cabinet 18 and pivotally attaches by its second end 40 to the underneath side 46 of the board 12 at a front end 48 of the board 48. As illustrated in FIGS. 1 and 2, the first end 38 of the telescoping hinge 10 pivotally attaches to the inside surface 42 by means of clips 49 that attach to the inside surface 42 by means of screws 51 or other suitable fastening devices.

As illustrated in FIGS. 8 and 10, the underneath side 46 of the board 48 is provided with a t-shaped groove 50 that receives the telescoping hinge 12 when the board 12 is pivoted upward into its vertical storage position 16. As shown in FIGS. 6 and 2, a u-shaped bracket 52 attaches over the second end 40 of the sleeved hinge 10 to pivotally secure the second end 40 within a t-shaped portion 54 the t-shaped groove 50. The t-shaped portion 54 is located at the front end 48 of the board 12.

As shown in FIGS. 1, 2 and 3, the back end 20 of the board 12 pivotally mounts to opposite sides 56 of the cabinet 18 via a pivot bracket 58. Referring now also to FIGS. 7, 9 and 10, the pivot bracket 58 secures to a top side 60 of the ironing board 12 at the back end 20 of the board 12 by means of screws 62 or other suitable fastening means. The back end 20 of the board 12 has a notch 63 therein for receiving a rod portion 64 of the pivot bracket 58. The rod portion 64 extends beyond the rest of the pivot bracket 58 to form ears 65 on either side of the pivot bracket 58. The two ears 65 extend outward so that one ear 65 extends beyond each side 66 of the board 12. An opening 68 receives each ear 65, and each of the two sides 56 of the cabinet 18 has one opening 68 therein. The openings 68 are level with each other so that the board 12 pivots within the cabinet 18, the board 12 is level when in its horizontal in use position 14, and the board 12 can be pivoted between its lowered horizontal position 14 and its raised vertical storage position 16. This arrangement, i.e. with the sleeved hinge 10 being fully received within the t-shaped groove 50, allows the cabinet 18 to be made so that the cabinet 18 is very thin.

The sleeved hinge 10 makes the board 12 particularly stable and strong when the board 12 is in its horizontal position 14. This is because the sleeved hinge 10, which supports the board 12, has the t-shaped bar 24 fully inserted within the t-shaped sleeve 26 when the board 12 is in its horizontal position 14. Thus, the board 12 is supported by both the strength of the bar 24 and sleeve 26 when the board 12 is in its horizontal position 14.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A hinged sleeve for supporting a wall mounted ironing board comprising:

a t-shaped rod having a t-shaped end and an opposite straight end, a t-shaped sleeve having a t-shaped end and an opposite straight end, said straight end of said t-shaped sleeve being hollow and telescopically receiving the straight end of said t-shaped rod, said t-shaped sleeve fully receiving the entire length of said t-shaped rod and said t-shaped rod entering the full length of the t-shaped sleeve when supporting an ironing board in a horizontal position so that the rod and sleeve function as a unit to support the ironing board.

2. A hinged sleeve for supporting a wall mounted ironing board according to claim 1 wherein said t-shaped sleeve and said t-shaped rod attach to a wall mounted ironing board to support the board in a horizontal position.

3. A hinged sleeve for supporting a wall mounted ironing board according to claim 2 wherein said t-shaped sleeve pivotally attaches to an inside surface of a bottom of a cabinet containing an ironing board and said t-shaped rod pivotally attaches to an underside of the ironing board.

4. A hinged sleeve for supporting a wall mounted ironing board according to claim 3 wherein said t-shaped rod and said t-shaped sleeve are received within a t-shaped groove provided on an underneath side of a wall mounted ironing board when the ironing board is in its stored in its vertical position.

5. A hinge sleeve and wall mounted ironing board combination comprising:

a t-shaped rod having a t-shaped end and an opposite straight end, a t-shaped sleeve having a t-shaped end and an opposite straight end, said straight end of said t-shaped sleeve being hollow and telescopically receiving the straight end of said t-shaped rod said t-shaped sleeve fully receiving the entire length of said t-shaped rod and said t-shaped rod entering the full length of the t-shaped sleeve when supporting an ironing board in a horizontal position so that the rod and sleeve function as a unit to support the ironing board, and said t-shaped sleeve and said t-shaped rod attaching to a wall mounted ironing board to support the board in a horizontal position.

6. A hinged sleeve and wall mounted ironing board combination according to claim 5 wherein said t-shaped sleeve pivotally attaches to an inside surface of a bottom of a cabinet of a wall mounted ironing board and said t-shaped rod pivotally attaches to an underside of an ironing board of a wall mounted ironing board.

7. A hinged sleeve and wall mounted ironing board combination according to claim 6 wherein said t-shaped rod and said t-shaped sleeve are received within a t-shaped groove provided on an underneath side of the ironing board when the ironing board is in its stored in its vertical position within the cabinet.

* * * * *